US009728925B2

(12) United States Patent
Tontsch et al.

(10) Patent No.: US 9,728,925 B2
(45) Date of Patent: Aug. 8, 2017

(54) CARBON BRUSH HAVING A CENTERING SLEEVE

(71) Applicant: SCHUNK KOHLENSTOFFTECHNIK GMBH, Heuchelheim (DE)

(72) Inventors: Klaus-Georg Tontsch, Biebertal (DE); Reiner Pfeiffer, Wettenberg (DE)

(73) Assignee: SCHUNK KOHLENSTOFFTECHNIK GMBH, Heuchelheim (DE)

( * ) Notice: Subject to any disclaimer, the term of this patent is extended or adjusted under 35 U.S.C. 154(b) by 304 days.

(21) Appl. No.: 14/402,901

(22) PCT Filed: May 31, 2013

(86) PCT No.: PCT/EP2013/061269
§ 371 (c)(1),
(2) Date: Nov. 21, 2014

(87) PCT Pub. No.: WO2013/178790
PCT Pub. Date: Dec. 5, 2013

(65) Prior Publication Data

US 2015/0111397 A1 Apr. 23, 2015

(30) Foreign Application Priority Data

May 31, 2012 (DE) ..... 10 2012 209 222

(51) Int. Cl.
*H01R 39/58* (2006.01)
*H01R 39/59* (2006.01)

(52) U.S. Cl.
CPC ..... *H01R 39/58* (2013.01); *H01R 39/59* (2013.01)

(58) Field of Classification Search
CPC ..... H02K 13/00; H01R 39/00; H01R 39/26; H01R 39/36; H01R 39/58; H01R 39/59; H01R 43/12; G08B 21/00; G08B 21/182
(Continued)

(56) References Cited

U.S. PATENT DOCUMENTS 1,425,632 A 8/1922 Click
2,935,632 A 5/1960 Schmitz, Jr.
(Continued)

FOREIGN PATENT DOCUMENTS

CN 101533985 A 9/2009
DE 1463992 A1 6/1969
(Continued)

OTHER PUBLICATIONS

English Translation of Notification of First Office Action Chinese Patent Application No. 201380028886.4 ssue Date: Mar. 3, 2016.
(Continued)

*Primary Examiner* — Tran Nguyen
(74) *Attorney, Agent, or Firm* — King & Schickli, PLLC

(57) ABSTRACT

The invention relates to a carbon brush (2), having a wear limit indicating function, having a current-carrying stranded wire being arranged in the brush body (4), and having a stranded indicating wire (10), which, at a stranded wire end section (12), is surrounded and fixed by a sleeve (8) having an infeed opening (22), wherein the sleeve (8) is arranged in a recess (6) being formed in the brush body (4). The sleeve (8) is formed as a centering sleeve, the inner diameter (26*a*, 26*b*) of which at the infeed opening (22) nearly corresponds to the outer diameter (24) and features a tapering (30) that is conical in the infeed direction.

11 Claims, 3 Drawing Sheets

Figure 1A:
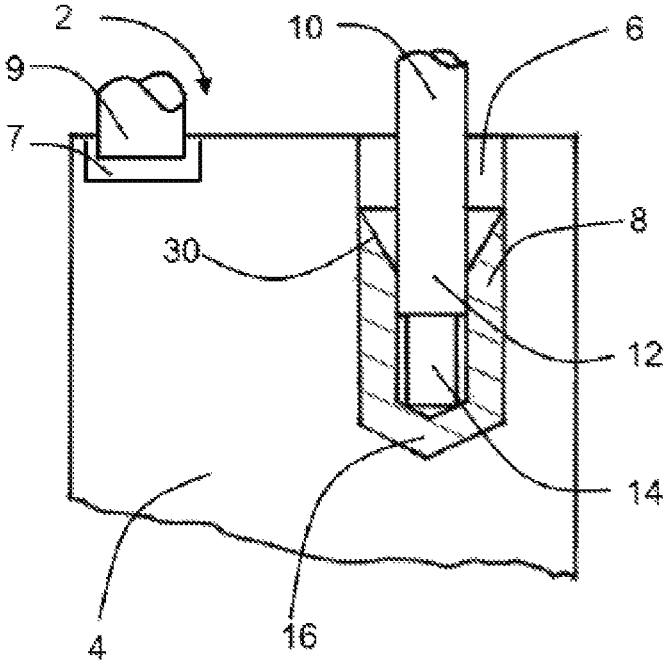

(58) Field of Classification Search
USPC ..... 310/242–253
See application file for complete search history.

(56) References Cited

U.S. PATENT DOCUMENTS

| | | | | | |
|---|---|---|---|---|---|
| 4,333,095 | A | * | 6/1982 | Silva | H01R 39/58 200/61.41 |
| 4,344,072 | A | * | 8/1982 | Harper, Jr. | H01R 39/58 310/242 |
| 4,636,778 | A | * | 1/1987 | Corkran | G08B 21/182 200/61.41 |
| 5,488,261 | A | * | 1/1996 | Swoboda | H01R 43/12 310/245 |

FOREIGN PATENT DOCUMENTS

| | | | |
|---|---|---|---|
| DE | 4111206 | A1 | 10/1992 |
| DE | 102010031415 | A1 | 1/2012 |
| EP | 0585591 | A1 | 3/1994 |
| EP | 0624937 | A1 | 11/1994 |
| EP | 0512234 | B1 | 1/1996 |
| EP | 2099102 | A1 | 9/2009 |
| FR | 1412458 | A | 10/1965 |
| JP | S4916703 | U | 2/1974 |
| JP | S5037801 | U | 4/1975 |
| JP | S5717268 | U | 1/1982 |
| JP | S61173477 | A | 8/1986 |

OTHER PUBLICATIONS

PCT/EP2013/061269 International Search Report Aug. 27, 2013.

* cited by examiner

CARBON BRUSH HAVING A CENTERING SLEEVE

FIELD OF THE INVENTION

'The invention relates to a carbon brush, having a wear limit indicating function, having a current-carrying stranded wire being arranged in a brush body, and having a stranded indicating wire, which, at a stranded wire end section, is surrounded and fixed by a sleeve having an infeed opening, wherein the sleeve is arranged in a recess being formed in the brush body.

BACKGROUND OF THE INVENTION

With hand tools that are driven electrically, such as drilling machines that are commercially operated, it is important, for using the working hours as efficiently as possible, to be able to schedule maintenance measures in conjunction with the hand tools accurately enough, in particular in the context of measures relating to replacing the carbon brushes. Hence, it is ensured that the required wear parts are available in good time for the anticipated maintenance date and that lost working hours due to unexpected maintenance work can be avoided to the greatest extent.

In order to inform about the condition of the carbon brushes in good time and to provide a warning that the wear limit of the carbon brushes will soon be reached, it is therefore standard practice to provide carbon brushes with a so-called stranded indicating wire, which is formed or arranged in the brush body of the carbon brush such that, for announcing that the wear limit will soon be reached, an electrically conductive contact between the stranded indicating wire and the slip ring or the commutator of the drive engine of the hand tool is established.

In order to avoid damage to the hand tool as a result of the operation of the hand tool being continued even after the wear limit has been reached, the indicating function that is fulfilled by the stranded indicating wire can additionally be complemented with a disconnection function, which brings about a compulsory interruption in the operating current supply via the stranded wire that carries the (operating) current. Said disconnection function can be configured as a mechanical disconnection mechanism. Thus, a disconnection mechanism is known, for instance from the document EP 0 512 234 BI, which mechanism is formed in the brush body as a component assembly that is composed of several components. The disconnection mechanism features a disconnection nipple which is formed so as to be electrically insulating, and which, being spring-preloaded, is received in a receiving bore. For generating the spring-preload, a pressure spring being coupled to the disconnection nipple is supported at a compressed filling compound which has been filled into the receiving bore, and which consists of a metal powder as a rule. By mechanically lifting the carbon brush off the commutator or off the slip ring of the electric engine, the interruption in the current supply is guaranteed.

SUMMARY OF THE INVENTION

Due to this complex design of the disconnection mechanism, producing the same also proves to be correspondingly laborious and time-consuming, having a plurality of production steps to be performed one after the other, starting with introducing the receiving bore, subsequently installing the combination of the disconnection nipple/pressure spring and finally partially filling the receiving bore with the metal powder for creating an abutment for the pressure spring.

One possibility of avoiding the laborious and time-consuming construction of a mechanical disconnection function consists in forming the stranded indicating wire in such a way that it also fulfills the disconnection function, in an electrical manner, besides the indicating function. Here, the stranded indicating wire is formed as a contact conductor for the disconnection function for activating an electrical disconnection device. Besides, both the recess for the stranded indicating wire and the recess for the stranded wire that carries the operating current are configured as receptions that are dimensioned as identically as possible.

Introducing the stranded wires into the carbon brush body turns out to be rather laborious and time-consuming in terms of manufacture, since the stranded wire ends that consist of a plurality of thin single wires, as a rule, have to be bent manually so as to be U-shaped or loop-shaped and have to be fed into the carbon brush body. In order to simplify this manufacturing process and to keep the required bore diameter of the recess as small as possible, so as not to weaken the brush body, the patent application publication DE 41 11 206 A1 proposes holding or guiding the stranded indicating wire by means of a sleeve, which is, in turn, fixed in the recess with respect to its position.

However, with this manner of fastening, too, feeding the stranded wire bundle into the sleeve proves to be a manufacturing step that is particularly time-consuming and that has to be carried out carefully, this manufacturing step therefore still being carried out manually and laboriously in most cases.

Thus, as a part of efficiently manufacturing carbon brushes, the task on which the invention is based consists in designing the coupling of a stranded wire, in particular of the stranded indicating wire, to the carbon brush in such a way that the stranded wire can securely be fixed in the carbon brush body with just a few simple production steps.

In conjunction with the preamble of claim 1, this task is solved in that the sleeve is formed as a centering sleeve, the inner diameter of which at the infeed opening corresponds to an outer diameter and features a tapering that is conical in the infeed direction.

Starting from a basic cylindrical shape of the sleeve and from a wall thickness of approximately half the inner diameter, in accordance with the invention, the inner diameter at the stranded wire infeed opening is extended to the size of the outer diameter, such that the front surface of the sleeve approaches zero and that there is no stop surface as an obstacle to the stranded wire bundle to be fed in when it is fed into the sleeve. In conjunction with the tapering of the inner diameter that is conical towards the recess bottom, a stranded wire being insulated in its stranded wire end section, but in particular also a stranded wire being stripped from its insulation in the stranded wire end section, slides into the interior of the centering sleeve without any resistance. In the case of a stranded wire being stripped from its insulation, it is precluded that single stranded wires be turned out and, hence, the risk of an unreliable coupling is precluded, in contrast to a sleeve having a planar front surface at the infeed opening. Hence, mounting the stranded wire is simplified both in the case where the stranded wire is initially coupled to the centering sleeve outside of the carbon brush and where the unit consisting of the stranded wire end section and the centering sleeve is subsequently introduced into the carbon brush body, and in the case where the stranded wire is fed into the centering sleeve already being premounted in the carbon brush body.

In a preferred design, the conical tapering of the inner diameter is confined to a section adjoining the infeed opening, wherein the centering sleeve, abutting thereon, features a section having a constant inner diameter. The conical tapering can basically extend over the entire length of the sleeve, which means that the sleeve constitutes an inner cone in its entirety, the inner diameter of which, when the outer diameter is constant, steadily decreases from the infeed edge having an arbitrarily small wall thickness up to the opposite end. Preferably, the conical course, in the longitudinal direction of the centering sleeve, is, however, confined to a section adjoining the infeed opening, an area having a constant inner diameter abutting on said section. This design is simple to realize in terms of manufacture and lends sufficient stability to the sleeve.

The conical section being limited to the area of the infeed opening in its length is, in an advantageous manner, formed such that the cone angle of the centering sleeve corresponds to a point angle of a centering drill. This design makes molding the sleeve interior in a manner being simple in terms of manufacture possible, by drilling with a centering drill. A preferred cone angle of 30° guarantees that the stranded wire bundle can be fed in an unobstructed way.

In a further advantageous design, the centering sleeve is configured as a sleeve being closed on one side. This centering sleeve being designed in a cup-shaped way surrounds the stranded wire end section as an electrically insulating socket within the carbon brush body—if required, in conjunction with an insulating adhesive layer having been applied to the outer wall of the stranded wire—and prevents, in normal operation, an electrical contact with the carbon brush. An electrically conductive coupling to the carbon brush body or to the commutator does not arise before abrasion of the (cup) bottom has also been effected as a result of the carbon brush wear.

In an alternative configuration, the centering sleeve can be configured as a sleeve being open on both sides. In this case, the stranded wire end section protrudes beyond the lower sleeve end and can be encircled by an insulating adhesive layer.

Preferably, the stranded indicating wire and the centering sleeve are pressed together by crimping or said stranded indicating wire is glued into place in the centering sleeve. In terms of production, these coupling techniques are simple to carry out before the arrangement is fed into the carbon brush body and guarantee a coupling having enough tensile strength.

In a further design, the centering sleeve is glued into place in the recess of the brush body. Here, the centering sleeve can be glued into place with the aid of an insulating adhesive material.

Advantageously, the centering sleeve is produced from a manufacturing material that does not conduct electricity. The manufacturing material can, for instance, be an insulating plastic material. In this way, it is ensured that the stranded indicating wire does not establish any electrical contact with the carbon brush body or with the slip ring as long as the wear limit has not been reached, yet.

Alternatively, the centering sleeve can consist of metal, wherein an adhesive material that does not conduct electricity is used as an insulating sheathing when gluing the centering sleeve into place in the recess of the brush body, and wherein the centering sleeve is configured as a sleeve being open on both sides. Due to its elasticity, a metal sleeve allows both easily squeezing the stranded indicating wire and easily fitting the sleeve into the recess of the carbon brush body. In addition, the metal can reliably be glued into place. In the case of a metal centering sleeve, the same is configured so as to be open from below, so as not to damage the commutator.

In a further configuration, the stranded indicating wire and the centering sleeve are fixed in the recess by tamping them down with a tamping powder. If the drilling depth of the recess is greater than the sleeve length, the sleeve can be fixed with the aid of a tamping powder, having the stranded indicating wire being fastened in the same, by tamping a coated section of the stranded indicating wire down, above the sleeve infeed opening. The tamping powder can be a metal tamping powder in this case.

Alternatively to fastening a coated stranded indicating wire, the stranded wire end section, within the recess, can feature exposed single wires, which are surrounded by an insulating tamping powder to fix the stranded indicating wire and the centering sleeve. In this case, due to the insulating tamping powder, a coating of the stranded indicating wire is Figures not required, such that the centering sleeve and the bore diameter of the recess can be construed so as to be smaller and, hence, more stable.

BRIEF DESCRIPTION OF THE DRAWING FIGURES

Preferably, the centering sleeve is utilized as a sleeve that is made of a conductive manufacturing material for coupling the current-carrying stranded wire to the brush body. Using a sleeve in a configuration as a centering sleeve is not confined to fastening a stranded indicating wire, but can rather also advantageously be utilized in the form of a metal sleeve for producing a mechanical and electrical coupling of the current-carrying stranded wire.

Figure 1B:
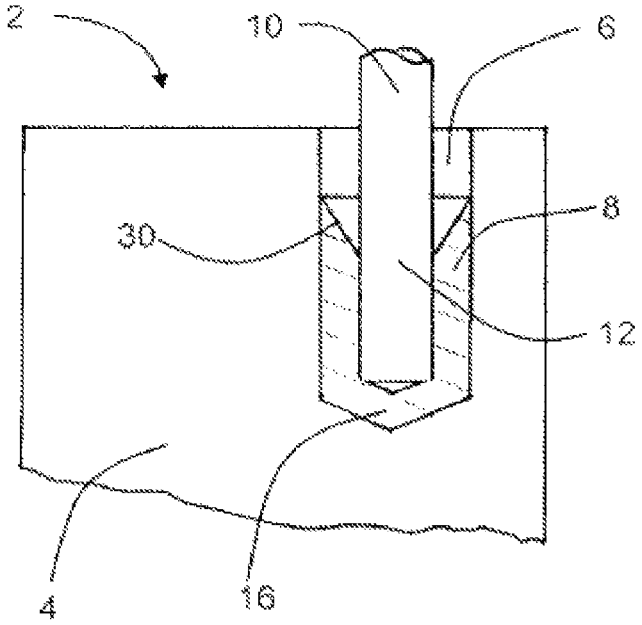
Figure 2:
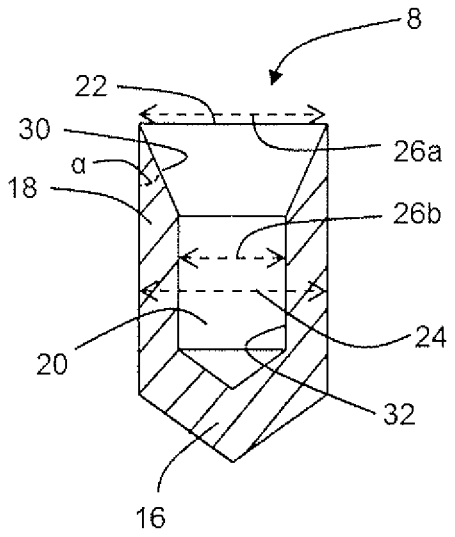
Figure 3:
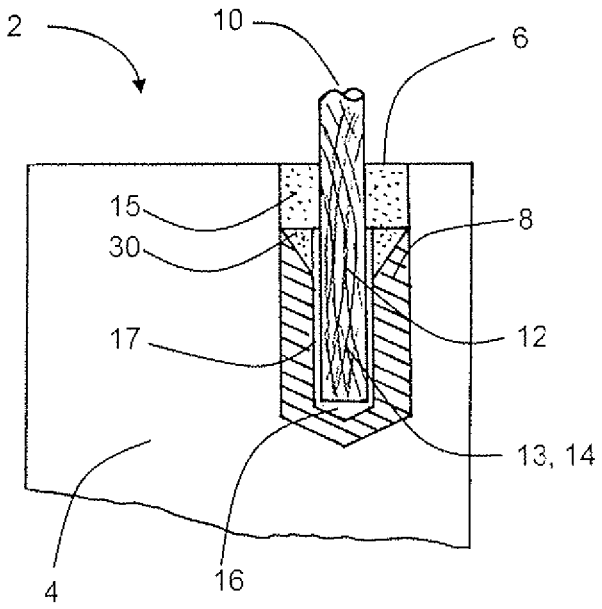

Further advantageous design features result from the following description and from the drawings, which explain a preferred embodiment of the invention by reference to examples. In the figures:

FIG. 1*a*: shows a part of a carbon brush having a stranded indicating wire being stripped from its insulation in its stranded wire end section and having a centering sleeve in accordance with the invention, FIG. 1*b*: shows a part of a carbon brush having a stranded indicating wire not being stripped from its insulation and having a centering sleeve in accordance with the invention, FIG. 2: shows a centering sleeve in accordance with the invention in a detailed illustration, FIG. 3: shows a part of a carbon brush having a stranded indicating wire being tamped down.

Figure 4:
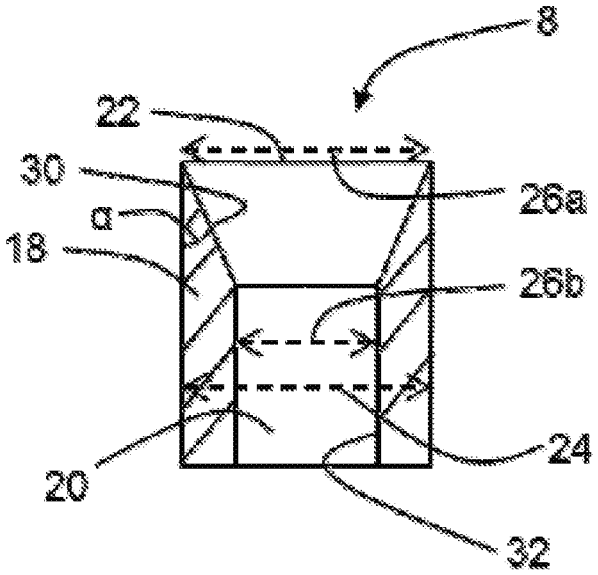

FIG. 4: shows a centering sleeve being open on both sides.

DETAILED DESCRIPTION OF THE INVENTION

FIG. 1*a* shows a carbon brush 2 having a carbon brush body 4, which features a recess 6. Preferably, the recess 6 is formed as a bore, into which a centering sleeve 8 in accordance with the invention has been inserted. The centering sleeve 8, in turn, receives a stranded indicating wire 10. Here, a stranded wired end section 12 of the stranded indicating wire 10 is coupled to the centering sleeve 8, preferably, the stranded wire end section 12 and the centering sleeve 8 are pressed together by crimping or the stranded wire end section 12 is stuck together with the centering sleeve 8. Besides, the carbon brush body 4 additionally features a further recess (7) for receiving a current-carrying stranded wire (9), via which the operating current is fed in, being transferred onto a slip ring via a contact surface at the lower end of the carbon brush 2.

The centering sleeve 8 itself has been glued into the recess 6, preferably with the aid of insulating adhesive material, and produces a cup-shaped insulating socket for the stranded wire end section 12 of the stranded indicating wire 10, wherein, at the end of the stranded wire end section 12, the single wires 13, 14 that are uncovered by stripping them from their insulation protrude into the interior 20 (FIG. 2) of the centering sleeve 8 like bundles. As wear of the carbon brush body 4 advances during the operation of the carbon brush 2, the contact surface of the carbon brush body 4 contacting the slip ring is shifted towards the lower end of the centering sleeve 8, such that the tip of an insulating bottom 16 of the centering sleeve 8 is also affected by the abrasion and, that the single wires 13, 14 contact the brush body 4 via the slip ring as wear advances further, whereby a warning signal is triggered.

FIG. 1*b* shows a further exemplary embodiment, which only differs from the configuration in FIG. 1*a* in that the stranded indicating wire 10 is not stripped from its insulation in its stranded wire end section 12, but rather features an insulating coating or molded-on portion.

FIG. 2 shows a centering sleeve 8 in accordance with the invention in detail. The centering sleeve 8—which is not illustrated to scale—is produced from a manufacturing material not conducting electricity and possesses the shape of a cylindrical base body 18 having a hollow space or interior 20, which, at the lower end, is limited by the bottom 16 being tapered and, at the upper end, features an infeed opening 22 for the stranded indicating wire 10. This cup-shaped design constitutes an insulated socket for the stranded wire end section 12 of the stranded indicating wire 10 within the carbon brush body 4. The cylindrical base body 18 features a constant outer diameter 24 as well as an inner diameter 26*a*, which, at the infeed opening 22, nearly corresponds to the outer diameter 24, such that the wall thickness and, hence, the front surface approach zero there. In particular with the centering sleeve 8 having been inserted into the carbon brush body 4, feeding the stranded indicating wire 10 in is significantly simplified in this way. The bundle 14 of single wires 13, 14 initially slides along in the bore 6 in the carbon brush body 4 and then advances into the interior 20 of the centering sleeve 8 up to the bottom thereof without experiencing the resistance of a stepped ledge.

An inner cone 30 narrowing towards the sleeve bottom 16 abuts on the infeed opening 22, which cone guides the single wires 14 and, in the further progress, fades into a section 32 having a constant inner diameter 26*b*. In contrast to known wire end sleeves, which feature a conical flange, the centering sleeve 8 in accordance with the invention can completely be inserted into a bore 6 of the carbon brush body 4 in an advantageous manner.

The hollow space 20, in a simple manner in terms of manufacture, is shaped by drilling with the aid of a centering drill, such that, for the cone angle $\alpha$, a value results that can be selected so as to correspond to the point angle of the centering drill. A cone angle $\alpha$ of 30° has proved to be favorable in order to be able to feed in the stranded wire end section 12 without having to fear the risk that the single wires 13, 14 be turned out. By implication, other cone angles $\alpha$ are also possible—even cone angles $\alpha$ being independent from a drill geometry, as long as feeding in the stranded wire end section 12 works easily and the advantage of shaping the cone by the centering drill is renounced.

In a simplified manner, the centering sleeve 8 can also be configured as a sleeve being open on both sides, not having a bottom 16 (see FIG. 4), if it is ensured that the exposed single wires 13, 14 do not contact the brush body 4. This can, for instance, be achieved by an adhesive material that does not conduct electricity and that has been introduced into the recess 6 before, for fixing the centering sleeve 8, the adhesive material completely lining the recess 6 in an insulating manner.

In an alternative design, the centering sleeve 8 can consist of a conductive manufacturing material, wherein an adhesive material that does not conduct electricity is used as an insulating sheathing when gluing the centering sleeve 8 into place in the recess 6 of the brush body 4. In this configuration, the insulating effect of a centering sleeve 8 having been produced from an insulating (plastic) material is replaced by the glue layer.

Furthermore, the centering sleeve 8 in accordance with the invention can also be utilized as a sleeve consisting of a conductive manufacturing material for coupling a current-carrying stranded wire to the brush body 4. In this arrangement for fixing the current-carrying stranded wire, too, the conical design 30 at the infeed opening 22 causes a simplified infeed of the current-carrying stranded wire. In this case, the centering sleeve 8 can also be configured as a sleeve being open on both sides, since a sheathing insulation within the brush body 4 is not required—in contrast, such an insulation even has to be avoided.

FIG. 3 shows a carbon brush 2 having a carbon brush body 4, in the recess 6 of which the stranded indicating wire 10 that is arranged in the centering sleeve 8 in accordance with the invention is tamped down. The centering sleeve 8 is formed as a sleeve consisting of an insulating material and being closed on one side, as in FIG. 1*a*, and receives the stranded wire end section 12 of a stranded indicating wire 10 not being coated in this embodiment. Here, the bundle 14 of exposed single wires 13, 14 protrudes into the interior of the centering sleeve 8 and is stuck together with an adhesive layer 17 there. Alternatively, crimping or pressing is also possible—depending on the material properties of the sleeve 8. The arrangement consisting of the stranded indicating wire 10 and of the centering sleeve 8 is fixed with the aid of an insulating tamping powder 15 above the infeed opening of the centering sleeve 8.

The invention claimed is:

1. A carbon brush (2), having a wear limit indicating function, comprising: a current-carrying stranded wire (9) carrying an operating current and being arranged in a brush body (4), and a brush-wear stranded indicating wire (10), wherein the brush-wear stranded indicating wire (10) includes a stranded wire end section (12) that is surrounded and fixed by a sleeve (8) having an infeed opening (22), wherein the sleeve (8) is arranged in a recess (6) being formed in the brush body (4), wherein the sleeve (8) is formed as a centering sleeve (8), said centering sleeve (8) has an inner diameter (26*a*, 26*b*), which at the infeed opening (22) corresponds to an outer diameter (24) and features a tapering (30) that is conical in an infeed direction, wherein the conical tapering (30) of the inner diameter (26*a*, 26*b*) is confined to a section adjoining the infeed opening (22) and wherein the centering sleeve (8) includes a section (32) having a constant inner diameter (26*b*) adjoining the conical tapering (30).

2. The carbon brush according to claim 1, wherein a cone angle ($\alpha$) of the centering sleeve (8) corresponds to a point angle of a centering drill.

3. The carbon brush according to claim 1,
wherein
the centering sleeve (8) is configured as the centering sleeve (8) being closed on one side.

4. The carbon brush according to claim 1,
wherein
the centering sleeve (8) is configured as the centering sleeve (8) being open on both sides.

5. The carbon brush according to claim 1,
wherein
the brush-wear stranded indicating wire (10) and the centering sleeve (8) are pressed together by crimping or in that said brush-wear stranded indicating wire (10) is glued into place in the centering sleeve (8).

6. The carbon brush according to claim 1,
wherein
the centering sleeve (8) is glued into place in the recess of the brush body (4).

7. The carbon brush according to claim 1,
wherein
the centering sleeve (8) is produced from a manufacturing material that does not conduct electricity.

8. The carbon brush according to claim 6,
wherein
the centering sleeve (8) is comprised of metal, wherein an adhesive material that does not conduct electricity is used as an insulating sheathing when gluing the centering sleeve (8) into place in the recess (6) of the brush body (4), and wherein the centering sleeve (8) is configured as the centering sleeve (8) being open on both sides.

9. The carbon brush according to claim 1,
wherein
the brush-wear stranded indicating wire (10) and the centering sleeve (8) are fixed in the recess (6) by tamping them down with a tamping powder (15).

10. The carbon brush according to claim 1,
wherein
the stranded wire end section (12) includes a plurality of exposed single wires (14) being surrounded by an insulating tamping powder (15) to fix the brush-wear stranded indicating wire (10) and the centering sleeve (8).

11. The carbon brush according to claim 1,
wherein
the centering sleeve (8) is utilized as the centering sleeve (8) that is made of a conductive manufacturing material for coupling the current-carrying stranded wire to the brush body (4).

* * * * *